US005290065A

United States Patent [19]

Kassal

[11] Patent Number: 5,290,065

[45] Date of Patent: Mar. 1, 1994

[54] ROLLER BLADE SKATE WHEELS COVER

[76] Inventor: Randy E. Kassal, 2519 N. Ocean Blvd., Boca Raton, Fla. 33431

[21] Appl. No.: 965,432

[22] Filed: Oct. 23, 1992

[51] Int. Cl.[5] ..... A63C 3/00

[52] U.S. Cl. ..... 280/825; 280/11.22; 36/132

[58] Field of Search ..... 280/825, 7.13, 7.14, 280/11.2, 11.21, 11.22, 11.23; 36/132

[56] References Cited

U.S. PATENT DOCUMENTS

| | | | |
|---|---|---|---|
| 2,213,966 | 9/1940 | Nygaard | 280/825 X |
| 3,135,526 | 6/1964 | Johns | 280/825 |
| 3,583,720 | 6/1971 | Fowlkes | 280/825 |
| 4,252,345 | 2/1981 | Cabral | 280/825 |
| 4,382,615 | 5/1983 | Gronborg et al. | 280/825 |
| 4,382,616 | 5/1983 | Olivieri | 280/825 |
| 5,183,292 | 2/1993 | Ragin, III | 280/825 |

FOREIGN PATENT DOCUMENTS

| | | | |
|---|---|---|---|
| 0547868 | 12/1930 | Fed. Rep. of Germany | 280/7.13 |

*Primary Examiner*—Margaret A. Focarino
*Assistant Examiner*—Peter C. English

[57] ABSTRACT

A wheel immobilizing cover for roller blade roller skates includes an elongated channel, a non-adjustable or fixed bridle of flexible, rubberized material which is subject to arcuate movement about an effective pivot point located on the sidewalls of the channel and an adjustable bridle coupled to the base of the channel. The adjustable bridle moves arcuately about the coupling point. The fixed bridle which is detached, at its outer end, from the base captures the front wheel of the roller blade skate wheels on the upper forward quadrant of the wheel and the adjustable bridle captures the rear wheel of the roller blade skate wheels on the upper rear quadrant of the wheel. When the front wheel rotates the wheel drags the flexible fixed bridle along the flexible, fixed bridle effectively pivoting about some pivot point on the channel and because of the difference in the paths of arcuate travel between the front wheel and the fixed bridle, the front wheel is clamped and immobilized. When the rear wheel rotates the wheel drags the adjustable bridle along and because of the difference in the paths of arcuate travel between the rear wheel and the adjustable bridle, the rear wheel is clamped and immobilized.

13 Claims, 2 Drawing Sheets

ROLLER BLADE SKATE WHEELS COVER

BACKGROUND OF THE INVENTION

1. Field of the Invention

The present invention relates to a cover for the wheels of a roller blade skate. In particular, the invention is a cover for the wheels of a roller blade skate for immobilizing the wheels and protecting the wheels of the skate.

2. Prior Art

Skates, both roller skates and ice skates are used in both recreational and professional sports. Skating rinks, for both ice skating and roller skating are very popular for both professional and recreational use of skates. In the recreational rink skating, the social aspects of the sport are almost as much a part of the sport as the actual skating.

All skates, whether they be roller skates or ice skates appear to have a common objection relative wearing the skate off the surface of the rink, in, for example, the social and personal rest areas and/or the refreshment area of the rink. The objections to off-the-skating-surface use of skates have foundation in safety, both of the person wearing the skate and the surface over which the person wearing the skate is walking. When a person is at a skating rink for skating purposes, the person usually takes a break between skating secessions for refreshment purposes. It is also usual for the rink-skater to attend refreshment and rest areas with the skates on his feet, since it is bothersome to remove and replace the skates, the skater usually keeps the skates on, until the skater is ready to leave the rink. It is also usual to require that persons wearing skates in the refreshment area and/or the rest area of rinks have a satisfactory cover over the roller skate wheels or the ice skate blade.

In the case of roller skates, there are, at present, two popular type of roller skates. One popular type is the conventional roller skate which has two longitudinally spaced pairs of wheels on one skate. This type of skate is hereinafter referred to as a conventional roller skate. Another popular roller skate is a multi-wheel skate in which the wheels of each skate are mounted in a single line, in tandem alignment. This type of roller skate is referred to hereinafter as a roller blade skate. A currently popular roller blade skate has four (4) wheels mounted on each skate of a pair of skates. The four (4) wheels of the wheel assembly on each skate, are mounted in a single, straight line, so as to be aligned, in tandem.

A cover for the wheels of a roller skate is taught by Grim in his U.S. Pat. No. 4,355,474, which addresses the problem of covering the wheels of a conventional roller skate. Grim teaches a sheet type cover which hooks on to the end structure of the skate mounting, covering the spaced pairs of wheels with a flat, rectangular sheet. The sheet cover provides a surface or sole on which a skater may walk, with some safety, when not on the skating rink.

The roller skate sole of the '474 patent is not practical for use on a roller blade skate because of the wheel alignment of the skate. Further, the Grim teaching addresses the problem of covering wheels on conventional roller skates, taking account that the conventional roller skate has a wheel arrangement that provides a rectangular, almost square, area with which to work. This same type of rectangular area is not found on, nor defined by the wheels mounted on a roller blade skate.

Ice skate guards, such as taught in U.S. Pat. Nos. 1,174,601 to Nathan; 1,686,667 to Kaskey; and, 3,583,720 to Fowlkes address the problem of protecting the blades of ice skates and do not address the problem of immobilizing the the wheels on wheel equipped skates, such as on the roller blade skate. The guards taught in the prior art for protecting the blades on ice skates are not designed for use on roller blade skates and fail to immobilize the tandem aligned wheels of the roller blade skates.

SUMMARY OF THE INVENTION

The present invention provides a novel skate wheel cover for covering and immobilizing the wheels of a roller blade roller skate. The skate wheels cover receives the tandem aligned wheels of a roller blade skate and, in response to rotation of the wheel secured by the cover, immobilizes the wheel. A wheels retaining channel is provided from which extends a first loop bridle, preferably a fixed, non-adjustable bridle, which extends from one end of the wheel retaining channel. A second loop bridle, preferably an adjustable bridle, extends from the other end of the wheels retaining channel. The fixed bridle makes contact with an exposed upper portion of one end wheel and the adjustable bridle makes contact with an exposed upper portion of another end wheel in the tandem aligned wheel assembly, the wheels between the end wheels being retained exclusively by the wheels retaining channel.

The fixed bridle extends outwardly from and above the wheel retaining channel and over an exposed portion of one of the end wheels, for example, the upper front quadrant of the front wheel of the aligned wheels of the skate. The fixed bridle, in securing to the front wheel assists the adjustable bridle in holding the cover on the wheel assembly and immobilizes the front wheel. The adjustable bridle is coupled to the wheel retaining channel so as to align therewith and extend outwardly from the channel, and away from the fixed bridle, so as to extend over an exposed portion of the other end wheel, for example, the rear wheel of the skate wheel assembly. The adjustable bridle extends over, and makes contact with the upper rear quadrant of the rear wheel and cooperates with the fixed bridle in holding the cover on the wheel assembly and immobilizes the rear wheel.

The wheel retaining channel has an inside wall-to-wall dimension which approaches the thickness of the skate wheels. The channel is preferably made from a rubber or rubberized material. However, other materials or combination of materials may be used, as desired. The channel receives, covers and retains the lower portion of the wheels of the skate, receiving the wheels in the groove of the channel. The base of the channel provides an inner surface to support the wheels and an outer surface on which the person wearing the skates may walk.

The fixed bridle, which is formed by extensions of the sidewalls of the channel which are separated from the base and connected at their common extremity, forming a loop, partially covers the forward longitudinal opening of the channel and extends angularly upward and over the front wheel, so as to grasp the upper front quadrant of the front wheel, for example. The central radial line along which the sidewalls extend forming the fixed bridle has an effective axis or pivot point for the bridle, which is offset from the axle or center of rotation of the wheel secured by the bridle. When the wheel rotates, the wheel, which is in contact with the bridle, tends to drag the bridle, which is a rubberized material, and is flexible, along with the wheel. The bridle, which is essentially a loop, has a limited and different arcuate travel from the arc of the wheel. As the bridle moves in its arc, the bridle will tighten its grip on the wheel, or function as a clamp on the wheel and resist the rotational movement of the wheel, immobilizing the wheel.

The adjustable bridle, which may be made of the same material as the wheel retaining channel, is connected to the base of the channel and extends angularly upward and away from the fixed bridle, so as to extend over and cover a portion of the upper rear quadrant of the rear wheel of the wheel assembly. As the fixed bridle grasps the front wheel, the adjustable bridle grasps the rear wheel. The effective axis of the adjustable bridle is offset from the axle or center of rotation of the wheel secured by the adjustable bridle so that the arcuate travel of the bridle and the arc of the rear wheel are different. When the rear wheel tends to rotate, the wheel, having contact with the adjustable bridle in the upper rear quadrant of the wheel, will drag the bridle along with the wheel and the bridle, moving on an arc which differs from the circumference of the wheel, will tighten its grip on, or clamp the rear wheel, immobilizing the rear wheel.

When both bridles are in position, the bridles secure the retaining channel to the bottom portion of the wheels of the skate. Thus, when the roller blade skate wheel cover is in place, the cover will not only immobilize the front wheel and the rear wheel but will also prevent rotation of the wheel or wheels between the front wheel and rear wheel. The roller blade skate wheel cover will also provide a surface or sole on which the wearer of the skate may safely walk, without fear of the skate wheels rotating.

OBJECTS OF THE INVENTION

It is an object of the invention to provide a cover for the wheels of a roller blade skate that immobilizes the wheels on the roller blade skate.

It is another object to provide a cover for the wheels of a roller blade skate that will permit walking safely, with the skate on the foot of the skater.

These and other objects will become more apparent when reading the following detailed description with reference to the accompanying drawings.

DETAILED DESCRIPTION OF THE INVENTION

In describing the invention with reference to the drawings, identical components shown throughout the drawings have identical element numbers, for convenience.

Figure 1:
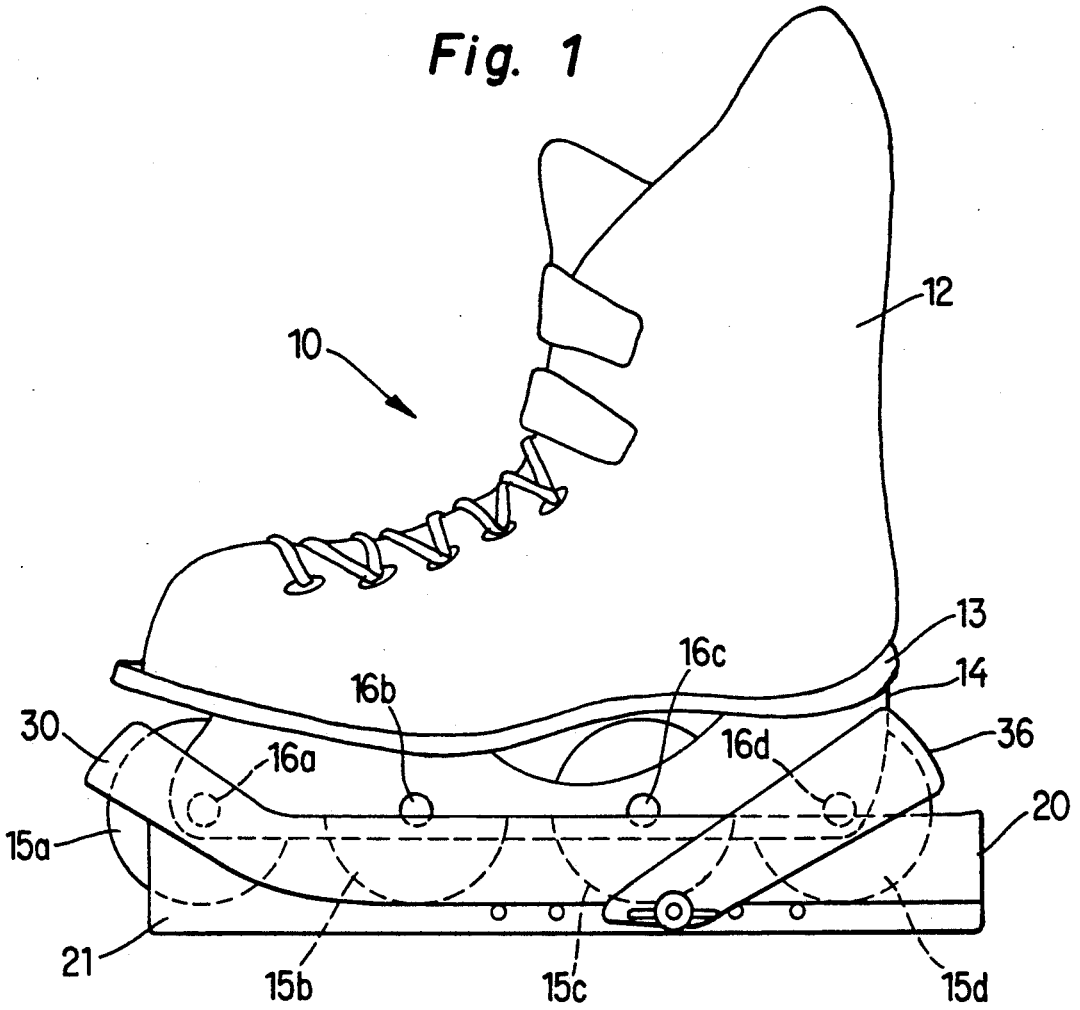
FIG. 1 is a pictorial representation of the invention used on a roller blade skate.

Referring to FIG. 1, a roller blade skate, 10, is represented with a boot or shoe 12. The boot has a sole 13 to which is attached the upper mounting 14 of a roller blade skate. Although the roller blade skate represented is attached to and integrated onto a boot or shoe, separate skates are made for temporary attachment to a boot or shoe and the present invention may be used on such skates. The skate wheels mounting 14 extends from the upper mounting and supports each axle 16*a*, 16*b*, 16*c* and 16*d* on which the respective wheels 15*a*, 15*b*, 15*c* and 15*d* are mounted for rotation thereon. The wheels are aligned in tandem. Although four (4) wheels are represented, a roller blade skate may have fewer or more wheels aligned in tandem on a single skate, according to the design of the roller blade skate.

Figure 2:
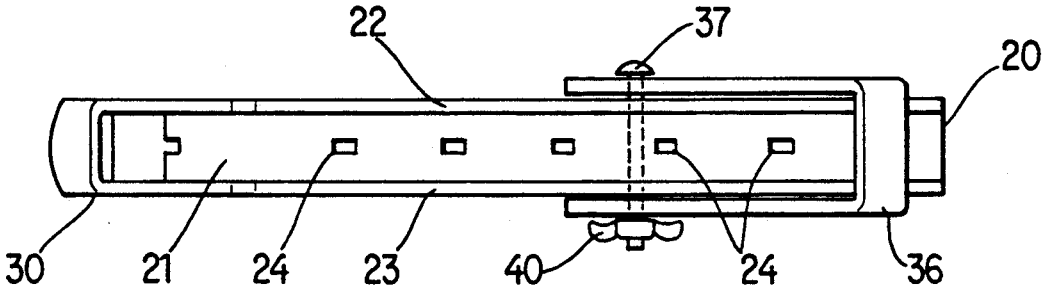
FIG. 2 is a representation, in top plan view, of the invention.
Figures 3, 3A:
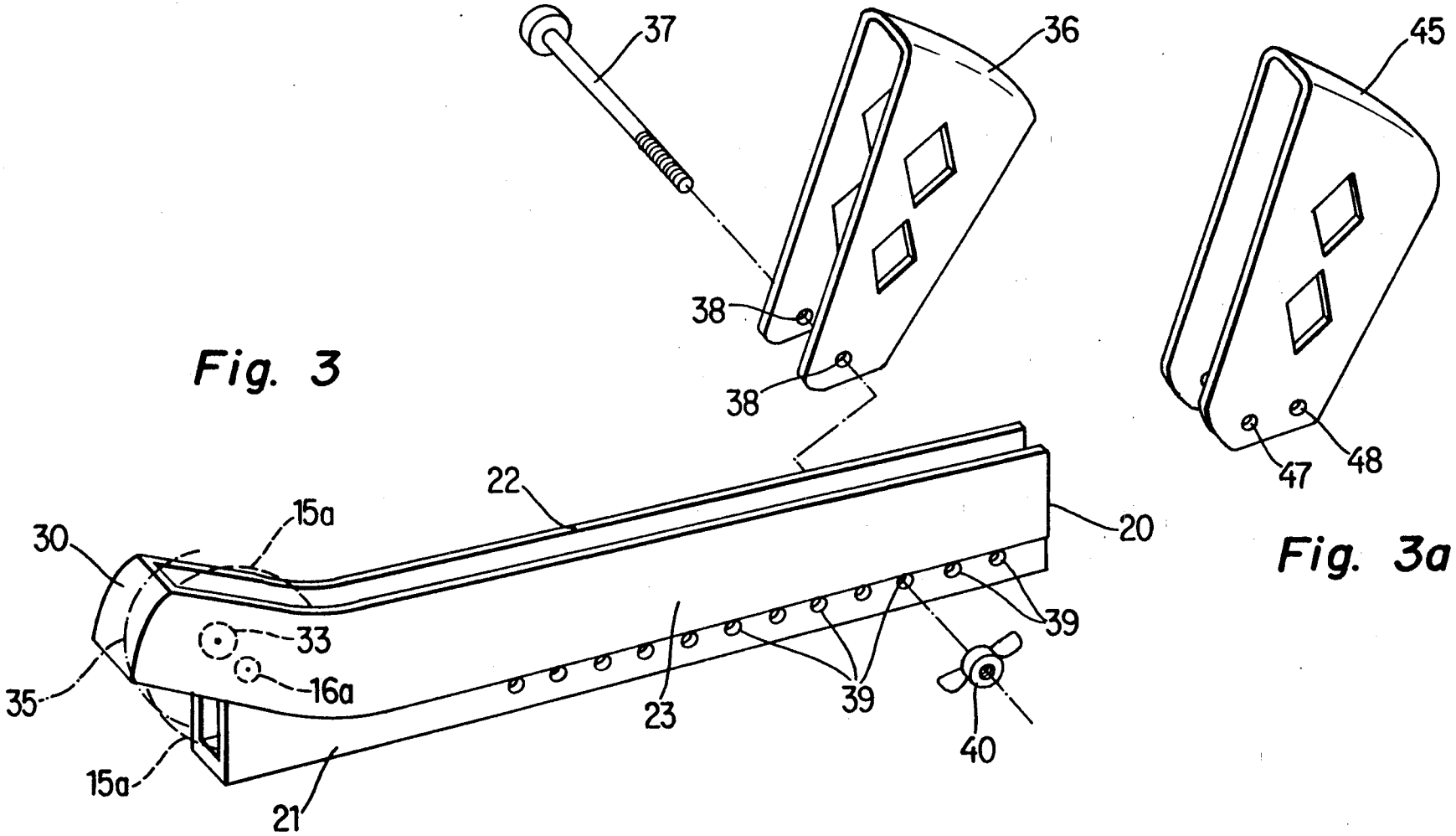
FIG. 3 is a representation of a preferred form of the invention, in exploded view; and, FIG. 3*a* is a representation of an alternate structure of an adjustable bridle.

The novel roller blade skate wheel cover includes a wheel retaining channel 20 which receives the wheel of the roller blade skate. The channel has a base 21 and side walls 22 and 23. The base 21 includes a plurality of ports 24 which provide drainage and air circulation. Coupled to the retaining channel are two (2) bridles. In the preferred embodiment, as represented in FIGS. 1, 2 and 3 one bridle is a fixed, or non-adjustable bridle, such as 30, which is integral with the sidewalls of the retaining channel, and the other bridle is an adjustable bridle, such as 36, which is adjustably attached to the retaining channel. This structure will fit most roller blade skates since the size of the cover may be effectively changed by adjusting the position of the adjustable bridle on the retaining channel. If desired both bridles may be made adjustable.

The fixed loop bridle 30 is made of a flexible rubberized material and is subject to limited arcuate movement about an effective axis or pivot point, represented in FIG. 3, by a broken line circle, as 33, on the side wall of the channel. The fixed bridle is represented as a front or forward loop bridle although the cover may be reversed so that the fixed bridle would serve as the rear bridle.

The fixed bridle is integral with the sidewalls, extending forward of and away from the side walls at which are separated, unattached or detached from the base 21, as shown in FIG. 3, an angle with a bridge spanning the extensions to the base, with common ends of the sidewalls connected, forming a loop which essentially captures the front wheel of the tandem aligned wheel on the upper forward quadrant of the front wheel.

The front wheel 15*a* is mounted for rotation about the axle 16*a*. The pivot point represented at 33 on which the bridle 30 moves arcuately, is offset from the center of the axle 16*a*. When the bridle 30 is over the wheel 15*a* and in contact with the upper forward quadrant of the wheel, the bridle captures the front wheel and, when the wheel 15*a* attempts to rotate, the wheel drags the bridle 30 along. The bridle 30, being flexible and with its end contacting the circumference of the wheel, follows the arc commanded by the radius from a pivot point represented at 33. By virtue of the difference in location of the center of rotation of the wheel 15*a* on the axle 16*a* and the location of the axis or pivot point 33 of the bridle 30, the loop bridle, dragged in a different arc, for example 35, than the circumference of the wheel 15*a*, closes on the wheel and acts as a clamp on the wheel, forcefully restraining the wheel 15*a* from rotation.

The rear or adjustable loop bridle 36 is secured to the base of the wheel retaining channel 20 by passing a pin 37 through the retaining hole 38 on the adjustable bridle and through a selected one of the spaced holes 39 on the base of the channel and through the second of the retaining holes on the bridle 36, as clearly represented in the exploded view of the invention in FIG. 3.

The loop bridle 36 extends, angularly, from the positioning pin in the hole in the base of the channel, upward from the channel, over the rear wheel 15*d*. The bridle 36 secures or captures the rear wheel on the upper rear quadrant of the wheel. The adjustable bridle is located along the base of the wheel retaining channel by the pin 37, on which the bridle pivots. The wheel 15*d* is mounted on the axle 16*d*, on which the wheel rotates. The center of rotation of the wheel 16*d* is offset from the pivot point or axis of the bridle 36 so that when the rear wheel 15*d* rotates the wheel, being in contact with the loop bridle, drags the bridle 36 along with the wheel and, because of the difference in the arcuate travel of the adjustable bridle and the effective arc of travel of the wheel, the bridle grabs or clamps the wheel, restraining the wheel from rotational travel, thus immobilizing the rear wheel.

A winged nut 40 is provided to secure the positioning pin 37 in the positioning hole 39. Several positioning holes are provided along the base of the retaining channel so that the novel roller blade wheel cover may be used on any size roller blade skate wheel assembly, limited only by the length of the wheel retaining channel.

An alternate structure of adjustable loop bridle 45 is represented in FIG. 3*a* which includes two (2) positioning holes 47 and 48. These two (2) positioning holes are spaced on the end of the bridle so as to align with two (2) adjacent positioning holes 39 in the base of the channel. The alternate structure bridle would use two (2) positioning pins.

A preferred embodiment of the invention has been represented and described and an alternate structure of adjustable bridle has been shown and described. Alternate structure has been suggested and alternate positioning of components has been suggested. Other changes and modifications, as may become apparent to those skilled in the art, may be made, without departing from the invention.

What is claimed is:

1. A cover for the wheels of a roller blade skate, said roller blade skate having a plurality of wheels arranged in tandem alignment, said cover comprising:

a) an elongated channel having a base and first and second walls said elongated channel for receiving said plurality of wheels of said roller blade skate;

b) a first bridle defined by said first wall and said second wall extending beyond said base at a first end of said elongated channel said first wall and said second wall connected at common ends defining a loop, said loop being detached at a front end thereof from said base, said first bridle for covering a first end wheel of said plurality of wheels on an upper forward quadrant of said first end wheel relative to the position of said first end wheel in said plurality of wheels; and c) a second bridle coupled to said elongated channel and extending away from said elongated channel at an angle, said second bridle for covering a second end wheel on an upper rear quadrant of said second end wheel, relative to the position of said second end wheel in said plurality of wheel.

2. A cover as in claim 1 and in which said first end wheel is mounted on an axle having a center about which said first end wheel rotates and said first bridle moves arcuately about a pivot point is flexible and effectively located on said elongated channel and said center of said axle and said pivot point are offset from each other.

3. A cover as in claim 1 and in which said first bridle is fixed.

4. A cover as in claim 3 and in which said second bridle is adjustable.

5. A cover as in claim 1 and in which said base further includes positioning holes spaced along said base for locating said second bridle along said elongated channel.

6. An apparatus for immobilizing at least a forward wheel and a rear wheel of a plurality of wheels on a roller skate having said plurality of wheels arranged in tandem alignment, said apparatus comprising:

a) an elongated channel having a base, a first wall and a second wall, said first wall and said second wall being in parallel relationship, said elongated channel arranged to receive at least a bottom portion of each wheel of said plurality of wheels;

b) said first wall and said second wall extending away from said base and joined at common ends for defining a first bridle said first bridle having a front end thereof detached from said base, for capturing said forward wheel on an upper forward quadrant of said forward wheel; and c) a second bridle coupled to said elongated channel and extending over an upper rear quadrant of said rear wheel for capturing said rear wheel on said upper rear quadrant.

7. An apparatus as in claim 6 and in which said first bridle has flexible characteristics and extends from said elongated channel at a first angle for capturing said forward wheel on said upper forward quadrant of said forward wheel and said forward wheel is mounted for rotation on a first axle and said first bridle is movable arcuately about a first pivot point located on said elongated channel, said first axle being offset from said first pivot point.

8. An apparatus as in claim 7 and in which said second bridle extends away from said elongated channel at a second angle for capturing said rear wheel on said upper rear quadrant of said rear wheel and said second bridle travels arcuately about a second pivot point second axle supporting said rear wheel for rotation.

9. A cover for covering each wheel of a plurality of wheels of a roller skate with tandem aligned wheels and for immobilizing a front wheel and a rear wheel of said plurality of wheels, said cover comprising:

a) an elongated channel having a base, a first wall and a second wall coupled for forming said channel, said channel adapted to receive each wheel of said plurality of wheels;

b) a first bridle defined by said first wall and said second wall separated from said base at common end portions of said walls extending beyond said base and jointly coupled at common ends of said common end portions said first bridle extending from said elongated channel for capturing said front wheel on an upper front quadrant of said front wheel; and, c) a second bridle coupled to said elongated channel by a coupling means and extending from said elongated channel for capturing said rear wheel on an upper rear quadrant of said rear wheel.

10. A cover as in claim 9 and in which said first bridle is fixed to said elongated channel.

11. A cover as in claim 10 and in which said second bridle is adjustably coupled to said elongated channel.

12. A cover as in claim 10 and in which said front wheel rotates on a first axis and said first bridle moves arcuately about first pivot point and said first axis is offset from said first pivot point.

13. A cover as in claim 12 and in which said rear wheel rotates on a second axis and said second bridle moves arcuately about a second pivot point and said second axis is offset from said second pivot point.

* * * * *